United States Patent [19]

Brice et al.

[11] Patent Number: 5,001,468

[45] Date of Patent: Mar. 19, 1991

[54] FLAT PANEL DISPLAY DEVICE WITH OPERATOR-CONTROLLED DISPLAY

[75] Inventors: Michel Brice, Chatou; Jean-Michel Buisson, Colombes; Jean-Marie Soubrier, Gentilly, all of France

[73] Assignee: Thomson-CSF, Paris, France

[21] Appl. No.: 239,425

[22] Filed: Sep. 1, 1988

[30] Foreign Application Priority Data

Sep. 4, 1987 [FR] France ..... 87 12333

[51] Int. Cl.[5] ..... G09G 3/02

[52] U.S. Cl. ..... 340/716; 340/700; 340/719

[58] Field of Search ..... 340/802, 784, 715, 716, 340/719, 765, 805, 700, 705, 980; 350/333, 334; 174/35 MS, 35 TS

[56] References Cited

U.S. PATENT DOCUMENTS

| | | | |
|---|---|---|---|
| 4,075,621 | 2/1978 | Salmon . | |
| 4,371,870 | 2/1983 | Biferno . | |
| 4,412,214 | 10/1983 | Tanaka et al. | 340/784 |
| 4,481,598 | 11/1984 | Ishiwata . | |
| 4,514,920 | 5/1985 | Shafrir et al. | 340/784 |
| 4,524,414 | 6/1985 | Kiyokawa | 340/716 |
| 4,567,481 | 1/1986 | Meier et al. | 340/784 |
| 4,594,572 | 6/1986 | Haubner et al. | 340/715 |
| 4,626,851 | 12/1986 | Tooze | 340/784 |

FOREIGN PATENT DOCUMENTS

| | | |
|---|---|---|
| 78402 | 5/1983 | European Pat. Off. . |
| 112050 | 6/1984 | European Pat. Off. . |

*Primary Examiner*—Alvin E. Oberley
*Assistant Examiner*—M. Fatahi-Yar
*Attorney, Agent, or Firm*—Cushman, Darby & Cushman

[57] ABSTRACT

The flat panel display device is organized so as to have, on its front side, a part with dedicated liquid crystals used in back-up mode, a matrix display part with non-dedicated liquid crystals used in normal mode, and a keyboard where the meaning of its keys is displayed by the matrix. Furthermore, the non-dedicated liquid crystal matrix is addressed so as to increase operational safety and displaying speed.

4 Claims, 3 Drawing Sheets

FIG.3
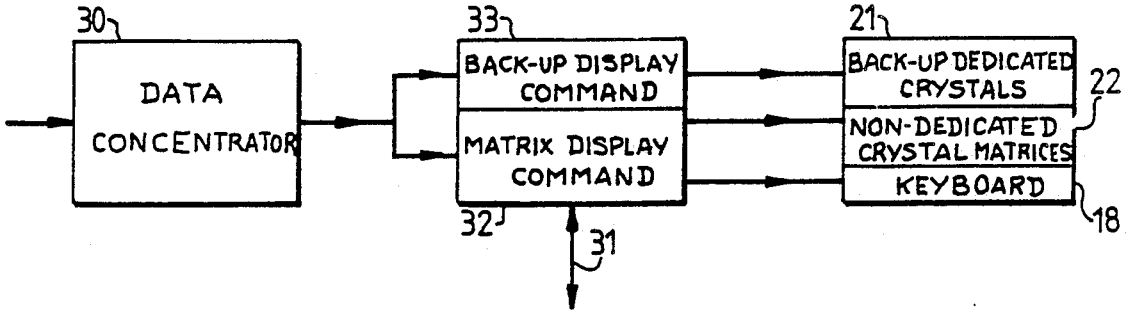
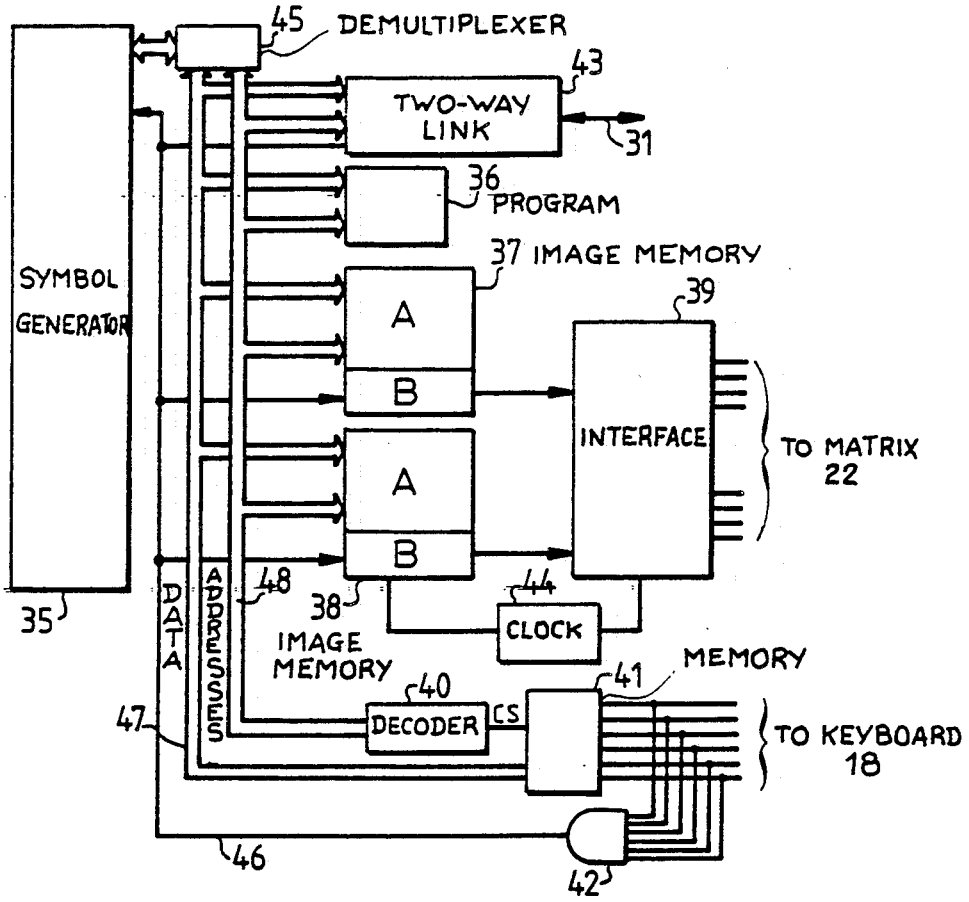
FIG.4

FLAT PANEL DISPLAY DEVICE WITH OPERATOR-CONTROLLED DISPLAY

BACKGROUND OF THE INVENTION

1. Field of the Invention

The invention relates to display devices of the type where the information is displayed on a flat panel, the type of information to be displayed being selected by the operator.

2. Description of the Prior Art

In aircraft, information such as the operational variables and parameters of the various items of on-board equipment is displayed by means of standard instruments such as graduated dials, meters, indicators, etc. and also, increasingly, through images obtained by means of cathode ray tubes, plasma panels, light-emitting diodes, electroluminescent panels or liquid crystal display devices. These image display devices enable the depiction of several parameters on one and the same surface, either simultaneously or successively or, at the operator's request, thus reducing the number of standard instruments on the dashboard.

A further advantage of these image displaying devices is that they can be placed at a large distance, from both the instruments for which they display the parameters and from the electronic circuits which control the preparation of the images and/or the display of information, thus making it easier to place them in the most suitable position for the operator.

The above two aspects, namely the display of several different items of information on one and the same screen and the remote control of the display of said information leads to a more efficient use of the available volume which, in principle, is reduced to the maximum extent in an aircraft, especially in the vicinity of the pilot.

For the operator in front of a display device of this type, it is important that he should be able to display the maximum amount of information on a single device, but he is limited by the size of the screen.

An aim of the invention, therefore, is to make a flat panel display device that enables the operator to select only that type of information which he wishes to display, for example information relating to the engine or information relating to the hydraulic circuits etc., by pressing one of the keys associated with the screen, each key corresponding to a certain type of information.

Of course, it is desirable for the number of keys to be limited for reasons of space and handling ease, and this reduces the total amount of information that can be displayed on one and the same device.

Another aim of the invention, then, is to make a flat panel display device in which the number of selection keys does not constitute a limit on the displaying possibilities of said device, this aim being achieved by stipulating several meanings per key, which are displayed successively on the screen at the operator's request.

In the event of failure of the flat screen as well as in circumstances where a number of the aircraft instruments work in back-up mode, it is important for the operator to be capable of displaying the essential parameters, even if it is only in simplified form.

Thus, another aim of the invention is to make a flat panel display device wherein there is provision for a back-up mode of operation.

As mentioned above, there is little space available, in the aircraft near the pilot, to set up a display device of this type. Consequently, another aim of the invention is to make a compact flat panel display device.

SUMMARY OF THE INVENTION

The invention relates to a flat panel display device with operator-controlled display of information, said device comprising:

- a flat screen associated with an illuminating device and
- a device to hold said flat screen,
- a keyboard placed adjacent to said flat screen,
- a frame covering the holding device and used as a support of the keyboard,
- means acting as a support to the above-mentioned different elements,
- electronic circuits to control the flat screen and the keyboard, placed near said supporting means, said circuits permitting the choice of several meanings per key of the keyboard to select a defined display of information on the screen,
- and a housing into which the supporting means are fitted and which acts as a shield.

This separation of the displays from the corresponding control circuits is planned so that the device has two operating modes: one is called a normal mode, during which the information is displayed only by the liquid crystal matrix and the other is called a back-up mode, during which the information is displayed only by the first part with dedicated liquid crystals.

In order to improve operating safety and displaying speed, it is provided that the control circuits of the non-dedicated liquid crystal matrix device comprise:

- means to create and record at least two images of the image to be displayed, in digital form, each created and recorded image corresponding to a certain intensity of each point of the matrix,
- means to re-arrange the points of each line of each created and recorded image so as to assemble them by odd number or even number or by half lines, and
- addressing means to select each point of the matrix and give it the information on intensity, coming from the combination of the items of information contained in each image that is created and recorded.

The points of each line can be re-arranged by means of:

- two shift registers which record the information corresponding to the recorded images,
- two multiplexer circuits connected to the shift registers and having four outputs each,
- a memory comprising eight shift registers, each connected to a single output of one of the two multiplexer circuits, and
- a control logic circuit which gives control signals to the shift registers, the multiplexer circuits and the memory so as to shunt the information contained in the shift registers to one of the registers of the memory depending on the order (whether odd or even) of the image points to which they are assigned and the concerned half-line.

BRIEF DESCRIPTION OF THE DRAWINGS

Other features and advantages of the present invention will appear from the following description of a special embodiment, made with reference to the appended drawings, of which:

FIG. 3 is a simplified functional diagram of the electronic circuits of the display device according to the invention;

FIG. 4 is a detailed functional diagram of the control circuit 32 of FIG. 3.

DESCRIPTION OF A PREFERRED EMBODIMENT

Figure 1:
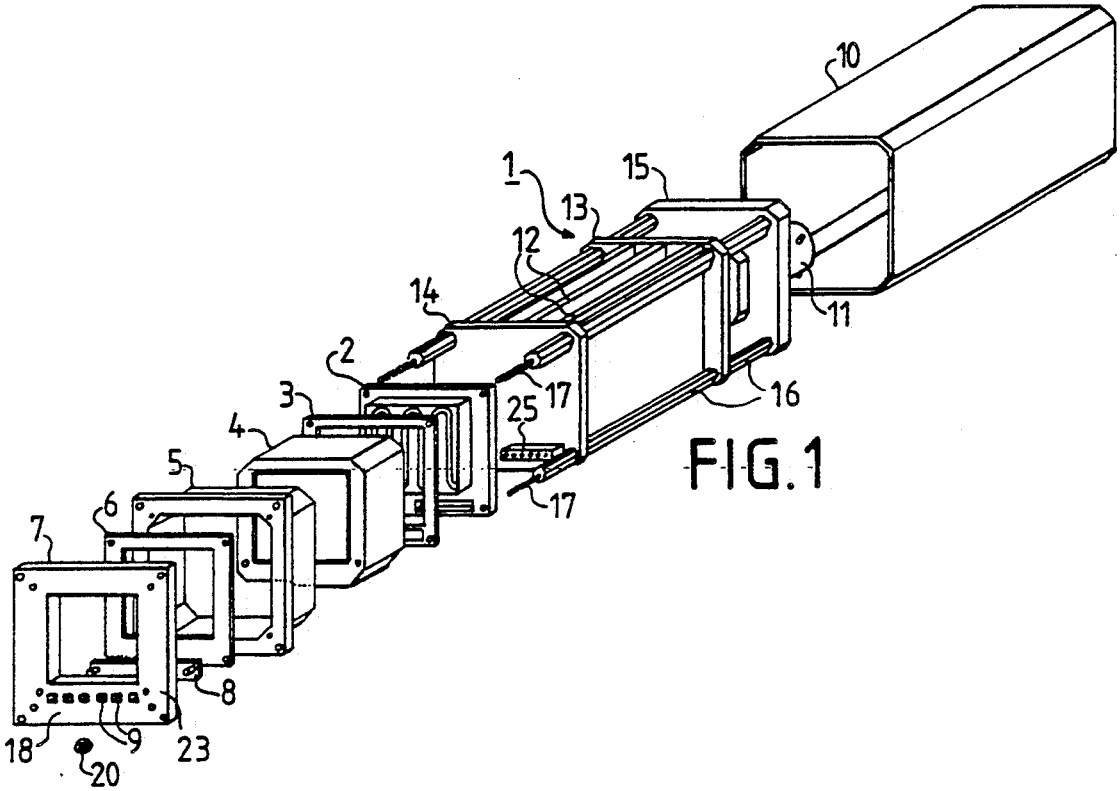
FIG. 1 shows an exploded view in cavalier projection of a flat panel display device according to the present invention.

The exploded view of FIG. 1 shows the different elements constituting a display device according to the present invention and how they are assembled together. This device has a frame 1 which acts as a support for the elements 2 to 11, as well as electronic circuits arranged on printed circuit boards 12, 13 and 14. The frame 1 has a back 15 solidly joined to a holding element 11 which is used to fix the display device. The back 15 acts as the support of a rigid parallelepiped structure made with tie-bars 16 and separating plates formed by the printed circuits 13 and 14. These tie-bars 16 may end in threaded rods, such as those marked 17 or tapped holes (not shown), so as to enable the different elements to be fitted together rigidly.

The threaded rods 17 are of a length sufficient to enable the threading of the following elements with a view to supporting them: an illuminating plate 2, joints 3 and 6, a collar 5 and a frame 7. The collar 5 clamps a flat panel 4 formed of liquid crystals and supports it. The frame 7, fitted with a glass plate (not shown) takes the six keys 9 of a keyboard 18, the support 8 of which consists of a printed circuit Bolts such as those marked 20 are screwed on to the threaded rods 17 so as to fix the elements 2 to 8 to the frame 1. After joining, the frame 1, containing the printed circuit boards 12 to 14 and supporting the elements 2 to 9, is inserted into a housing 10 which shields it. Thus, a relatively small-sized display device, for example, 188 mm×165 mm on the faces, with a depth of 230 mm, is obtained.

The front side of the display device according to the invention shall now be described with reference to figure 2. It consists of the frame 7 within which the liquid crystal panel 4 can be seen. With respect the type of crystals used, this panel is divided into two distinct parts: an upper part 21, consisting of dedicated liquid crystals, and a lower part 22, consisting of non-dedicated liquid crystals arranged in matrix form, said lower part taking up the greater part of the screen.

Figure 2:
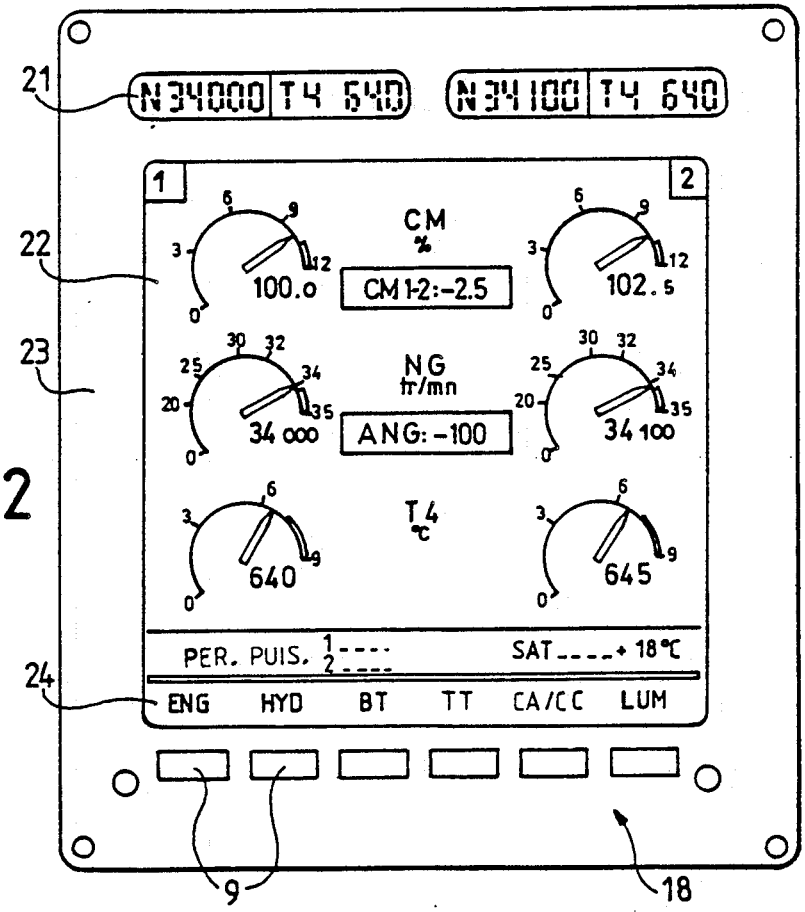
FIG. 2 shows a frontal view of the display device according to the invention, showing the flat panel in a certain display configuration.

Owing to the use of dedicated liquid crystals, the upper part enables the display of only a number of figures defined by construction, for example alphanumeric characters in the case of FIG. 2. This upper part is itself divided into two parts, one assigned to information concerning, for example, one of the two engines of the aircraft and the other part assigned to information concerning the second engine. This upper part is reserved for the display of data in back-up mode during which the other part of the screen is not used.

This restriction due to the dedicated crystals does not exist for the greater part of the screen, thus making it possible to create every type of figure and character, for example, the figures and characters shown. According to the invention, the bottom 24 of this part 22 is assigned to the display of the meaning of the keys 9 of the keyboard 18. These keys are placed in the frame 23 of the frame 7. It can thus be seen that it is easy to display the different meanings of each of the keys 9 as needed by the operator.

It will be noted that, in normal operation, only the part 22 shows indications while the upper part 21 is not used. In back-up mode, the lower part 22 displays no information while the upper part 21 gives indications presented solely with alphanumeric characters: these indications correspond to all or a part of the indications given in the lower part 22. Thus, in FIG. 2, the information displayed in the upper part 21 is information on the speed of the turbines (for example 34,000 and 34,100 rpm as pictured) and their temperature (640° C. and 640° C.).

Of course, in addition to unprocessed information, the panel can display information resulting from a processing of parameters such as, for example, information indicating proper functioning or failure.

The various electronic connections among the printed circuit boards 12 to 14, the flat panel 4 and the keyboard 18 are set up by means of a pin connection 25 which is borne by the printed circuit 14 and goes through the illuminating plate 2 and the joint 3.

The general arrangement of the electronic circuits needed to display the measurements and parameters of the different elements of an aircraft is given by the diagram of FIG. 3. The measurements and parameters are first put into form (in particular, they are encoded in digital form) in a data concentrating circuit 30. The signals given by the concentrator 30 are then processed in control circuits 32 and 33: the circuit 33 prepares the signals to be applied to the dedicated liquid crystals 21 and the circuit 32 prepares the signals to be applied to the non-dedicated liquid crystals matrix 22 as well as the keyboard 18.

In the diagram of FIG. 3, a connection 31 may be provided to a second data concentrator (not shown) which forms part of a second display device, thus creating a redundancy and, therefore, increased operational safety. This arrangement enables the display of data, normally displayed by the second display device, in the first display device and vice versa, especially in the event of the failure of one of the two display devices.

The data concentrator 30 shall not be described in greater detail because the different circuits that comprise it are known. The same applies to the circuit 33 that controls the dedicated liquid crystals 21. The circuit 32 that controls the non-dedicated liquid crystal matrix 22 is described below in detail with the help of FIGS. 4 and 5.

The control circuit 32 has a symbol generator 35 which receives the signals from the data concentrator 30, a program memory 36 and two image memories 37 and 38, an interface circuit 39 with the matrix of liquid crystals 22, a decoding circuit 40 for the pressed key, of the keyboard, associated with a state memory circuit 41 of the keys of said keyboard, an OR circuit 42, the inputs of which are connected to the keys of the keyboard, a two-way linking circuit 43 of the series type, connected to the above-mentioned second data concentrator, a clock circuit 44 giving synchronization signals to the memories 37 and 38 and to the interface circuit 39 and a demultiplexer circuit 45 placed between the symbol generator 35 and the elements 36, 37, 38, 40, 42 and 43.

The electrical connections among these different elements are set up either by single conductors, such as the one marked 46 for the output of the OR circuit 42, or by groups of wires or buses marked 47 for the data and marked 48 for the addresses.

The different elements listed above, with reference to FIG. 4, are known and are marketed, especially as regards the symbols generator 35 and the memories 37 and 38, by the firm TEXAS INSTRUMENTS. However, the control software programs were appreciably modified to allow for the fact that the image is to be displayed on a matrix display type color screen while the symbol generator 35 and the memories 37 are usually organized to achieve a display on a color screen of a cathode tube comprising three electron guns.

The memories 37 and 38 are of the random access type and each of them has, in fact, two memories, a large-sized memory A with, for example, 256,000 memory bytes and a smaller capacity memory B with, for example, 256 memory points but capable of working at very high speed. The memory A is used to record the image to be displayed on the matrix display 22 in digital form while the memory B is used to transfer the information constituting the image recorded in the memory A in series form. The way in which the information is transferred from the memory B to the interface circuit 39 and is processed in said circuit 39 shall be explained with reference to the description of FIG. 5.

The two memories 37 and 38 are needed to obtain several levels of intensity for each of the basic colors, red, green and blue, in the case of a color screen. With two memories, it is possible to obtain four different intensity levels depending on the value, 0 and 1, of the two binary digits constituting the information on the intensity of the color. Each memory, 37 or 38, therefore records the same image to be displayed, but does so with a particular value of intensity for each color point.

The circuit of FIG. 4 thus works as follows. The symbol generator 35 records, in the part A of the memories 37 and 38, an image to be displayed on the liquid crystal matrix or, more precisely, for each color point, red, green or blue, it records the intensity of this point. The memories 37 and 38 are read in synchronism and the binary digits read in A are recorded in the memory B. The content of each memory B is then transferred in the interface circuit 39 in series form at the rate of the pulses given by the clock circuit 44. The clock pulses are also applied to the interface circuit 39, to perform certain functions which shall be described with reference to FIG. 5, and to the liquid crystal matrix 22 to successively select the points of the matrix.

According to the invention, there is provision for organizing the liquid crystal matrix 22 so as to minimize the effect of a failure on the displaying capacity. For this purpose, the matrix is divided into two parts, a left-hand part (G) and a right-hand part (D) and in each part, for example, for each line, first the odd numbered points are selected and then the even numbered points. One of the ways to make a division of this type shall be described with reference to FIG. 5.

Figure 5:
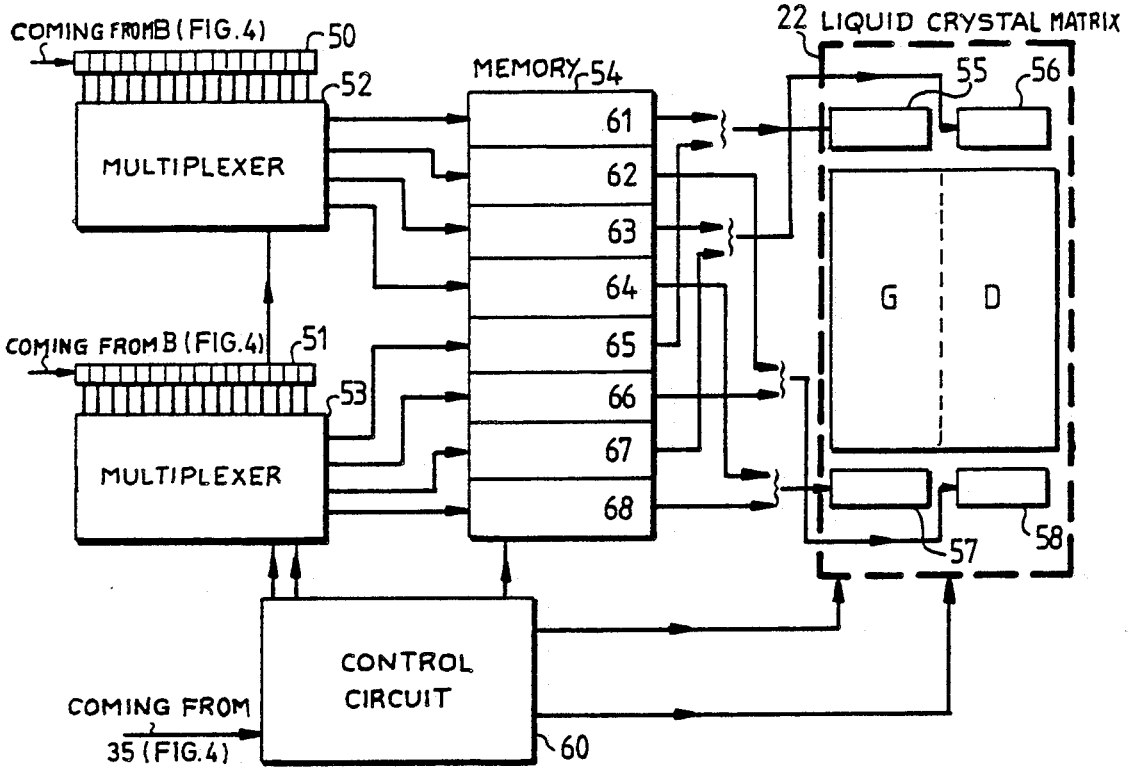
FIG. 5 is a detailed functional diagram of the interface circuit 39 of FIG. 4.

In the diagram of FIG. 5, the interface circuit 39 of FIG. 4 has two shift registers 50 and 51, two multiplexing circuits 52 and 53, a memory 54 and a control circuit 60. This diagram also shows the liquid crystal matrix 22 in a rectangle made with broken lines, said liquid crystal matrix 22 being divided into two parts G and D, along with its dual type, address registers 55 to 58.

The shift registers 50 and 51 and the multiplexer circuits 52 and 53 have the role, in combination with the memory 54, of re-ordering the data contained in the memories 37 and 38 so the left-hand or right-hand half of the image or its even numbered or odd numbered points can be displayed on the liquid crystal matrix 22.

As an indication, each shift register 50 and 51 has 16 positions, each multiplexer circuit 52 and 53 is of the 4/1 type and the memory 54 has eight registers 61 to 68 with 189 positions each in the case where the number of points per line, namely the number of columns of the matrix 22, is 756. The number of positions of each of the addressing registers, 55 to 58, is also 189.

The content of the memories B (FIG. 4) is transferred serially, in packets of 16 digits, to the associated shift register 50 or 51. Through the effect of the multiplexer circuit 52, the point No. 1 of the first line of the image of the memory 37 is transferred to the register 61, the point No. 2 to the register 62, the point No. 3 to the register 61, the point No. 4 to the register 62 and so on up to the point No. 378 (half of 756). Then, with the register 61 and 62 being full, the transfer is made into the registers 63 and 64 so that the odd numbered points are shunted towards the register 63 and the even numbered points are shunted towards the register 64. At the same time, and in synchronism, the points of the first line of the image of the memory 38 are shunted towards the register 65, or the register 66 as far as the points 1 to 378 are concerned, depending on whether they are odd numbered or even numbered respectively, and then to the register 67 or 68, as far as the points 379 to 756 are concerned, according to the same criterion.

The memory 54 is read by pairs of registers 61 and 65 which correspond to the odd numbered points 1 to 377 (the left-hand side G of the matrix), registers 63 and 67 for the even numbered points 379 to 755 (on the right-hand side), then the registers 62 and 66 for the even numbered points 2 to 378 and, finally, registers 64 and 68 for the points 380 to 756.

Of the information read in the memory 54, the information contained in the registers 61 and 65 is transferred to the dual register 55, the information contained in registers 62 and 66 is transferred into the dual register 57 and the information contained in the registers 64 and 68 is transferred into the dual register 58.

The information contained in each of the dual registers 55 to 58 is then combined sequentially with the signals that address the lines and columns to display the right color intensity at the point of the liquid crystal matrix selected by the addressing signals. These line and column addressing signals as well as all the other signals, needed for the working of the different circuits 50 to 54, are prepared by a control logic circuit 60 which also receives clock signals from the symbol generator 35 (figure 4).

The addressing circuits of the matrix 22 and their operation shall not be decribed in greater detail because they are known.

It must be noted that the fact of addressing the liquid crystal matrix by means of four circuits 55 to 58 instead of a single circuit enables an increase in the speed with which the information is displayed because these circuits work independently: this is a major advantage, to which must be added that of having increased operational safety.

What is claimed is:

1. A flat panel display device with operatorcontrolled display of information, said device comprising:

a flat screen of an illuminating device, a device for holding said flat screen, a keyboard placed adjacent to said flat screen, a frame covering the holding device and used for supporting the keyboard, means for supporting the flat screen, the holding device and the frame, electronic circuits for controlling the flat screen and the keyboard, said circuits placed proximate to said supporting means, said circuits allowing each key of the keyboard to have several meanings so as to select a defined display of information on the screen, and a housing into which the supporting means fit and which acts as a shield, said flat panel display device including two forms of display type crystals controlled by two distinct circuits of said electronic circuits, a first part of the display being made of nondedicated liquid crystals arranged in a dot matrix format with addressing by row and column of the matrix to form a display and a second part of the display being made of dedicated liquid crystals with segments arranged vertically and horizontally to form the display.

2. A display device according to claim 1 having two modes of operation, one mode called a "normal" mode in which the data is displayed only by said first part with non-dedicated liquid crystals, and the other mode, called a "back-up" mode, in which some of this information is displayed by said second part with dedicated liquid crystals in order to overcome a display failure in the first part.

3. A display device according to claim 1, wherein the control circuits of the liquid crystal matrix comprise:

means for generating and recording at least two images in digital form of the image to be displayed, with each generated and recorded image corresponding to a certain intensity of each point of the matrix.

means for rearranging data corresponding to the recorded images so that one of a left-hand half of an image, a right-hand half of the image, even-numbered points of the image and odd-numbered points of an image can be displayed on the liquid crystal matrix, and addressing means for selecting each point of the matrix and giving it intensity information derived from data from each generated and recorded image.

4. A display device according to claim 3, wherein the rearranging means comprises:

two shift registers, two multiplexer circuits connected to the shift registers, each multiplexer circuit having four outputs;

a memory comprising eight shift registers, each connected to a single output of one of the two multiplexer circuits, and a control logic circuit which passes control signals to the shift registers, the multiplexer circuits and the memory so as to shunt information contained in the shift registers to one of the registers of the memory depending on the rearranged data.

* * * * *